United States Patent [19]

Uratani

[11] Patent Number: 5,015,441

[45] Date of Patent: May 14, 1991

[54] ANTI-CORROSION METHOD OF AIR COMPRESSION DEVICE AND ANTI-CORROSION AIR COMPRESSION DEVICE

[76] Inventor: Eiichi Uratani, 3-1-9, Mukoujima, Sumida-ku, Tokyo, Japan

[21] Appl. No.: 307,111

[22] Filed: Feb. 3, 1989

[30] Foreign Application Priority Data

Feb. 4, 1988 [JP] Japan ..... 63-24121

[51] Int. Cl.[5] ..... C23F 11/04

[52] U.S. Cl. ..... 422/12; 422/13; 422/14; 417/431

[58] Field of Search ..... 422/12, 13, 14; 417/431

[56] References Cited

U.S. PATENT DOCUMENTS 4,830,584 5/1989 Mohn ..... 417/356

*Primary Examiner*—Robert J. Warden
*Assistant Examiner*—Timothy M. McMahon
*Attorney, Agent, or Firm*—Sprung Horn Kramer & Woods

[57] ABSTRACT

There are disclosed a method of preventing corrosion of the interior surfaces of air compression devices and an anti-corrosion air compressing device designed for carrying out the method. According to the method, a basic solution is supplied to the interior of the air compressor so that acidic water precipitated in the air compressor is neutralized or made basic by the basic solution. This prevents corrosion of the air compressor interior surface and thereby extends the life of the apparatus. The device comprises, a conventional air compressor, and a basic solution dispensing means connected to the air compressor. The dispensing means supplies the basic solution to the interior of the air compressor to neutralize acidic water precipitated in the compressor.

3 Claims, 1 Drawing Sheet

ANTI-CORROSION METHOD OF AIR COMPRESSION DEVICE AND ANTI-CORROSION AIR COMPRESSION DEVICE

BACKGROUND OF THE INVENTION

This invention relates to a method of preventing corrosion of the interior surfaces of air compression devices and similar apparatuses when the interior surfaces of the apparatuses come into contact with precipitated acidic water such as an acidic mist or acidic droplets. This invention also relates to an anti-corrosion air compression device for carrying out the above-mentioned method.

Air compressors are often used to introduce pressurized air into a variety of containers. Air is primarily composed of nitrogen gas and oxygen gas, and may also contain an appreciable amount of water vapor. Furthermore, because of air pollution, the air may also contain contaminants such as hydrogen sulphide which can be a component in acid rain. Therefore, when air is compressed by an air compressor, water vapor may precipitate and form acidic mist and droplets which may act as a corrosive agent on any exposed interior metal surface of the compressor. This may greatly shorten the life of the compressor and therefore increase the frequency and cost of servicing.

Previous attempts to prevent corrosion in such systems utilized expensive materials such as stainless steel, plated the interior surface with a more corrosion resistant metal (e.g., zinc), or coated the interior surface with a material (e.g., paint) more durable than the metal surface. These methods are costly and laborious, and in the cases of the use of plating or an interior coating, it is difficult to ensure that the protective coating is continuous over all of the interior surface, especially at joints.

SUMMARY OF THE INVENTION

It is therefore an object of the present invention to provide a method of preventing corrosion on the interior surfaces of air compression devices, in which it is unnecessary to use expensive materials or laboriously applied coatings.

It is also an object of the present invention to provide an anti-corrosion air compression device designed for carrying out said method. In the anti-corrosion compression device according to the present invention, the interior surface is effectively presented from corrosion without plating or having a coating applied.

In view of these and other objects, one aspect of the present invention is directed to a method of preventing the corrosion of the interior surfaces of air compression devices. According to this method, a basic solution is supplied to the interior of the air compressor continuously or at regular intervals so that the collected runoff from the interior of the air compressor is neutral or basic. This prevents corrosion of the air compressor interior surface and thereby extends the life of the compressor. The cost for carrying out this method will be less than other methods which typically use stainless steel construction, plating with more durable metal, or protective coatings. It is preferred that the basic solution is prepared by electrolyzing a solution of water containing a substance such as salt, chlorine and sulphur.

Another aspect of the present invention is directed to an anti-corrosion air compression device which comprises, a conventional air compressor, and a basic solution dispensing means. The dispensing means supplies the basic solution to the interior of the air compressor to neutralize the acidic water precipitated in the compressor. As a result, the air compressor is protected from corrosion on the interior surface.

The dispensing means may include, a solution container, a conduit tube interconnecting the container with the air compressor, and a pump for drawing the basic solution from the container into the conduit tube. The pump may be capable of pressurizing the basic solution to a pressure higher than the pressure of the compressed air in the compressor. The container may comprise an electrolysis device. The electrolysis device can produce the basic solution by electrolyzing a solution of water containing a substance such as salt, chlorine and sulphur.

DETAILED DESCRIPTION OF THE PREFERRED EMBODIMENT

Figure 1:
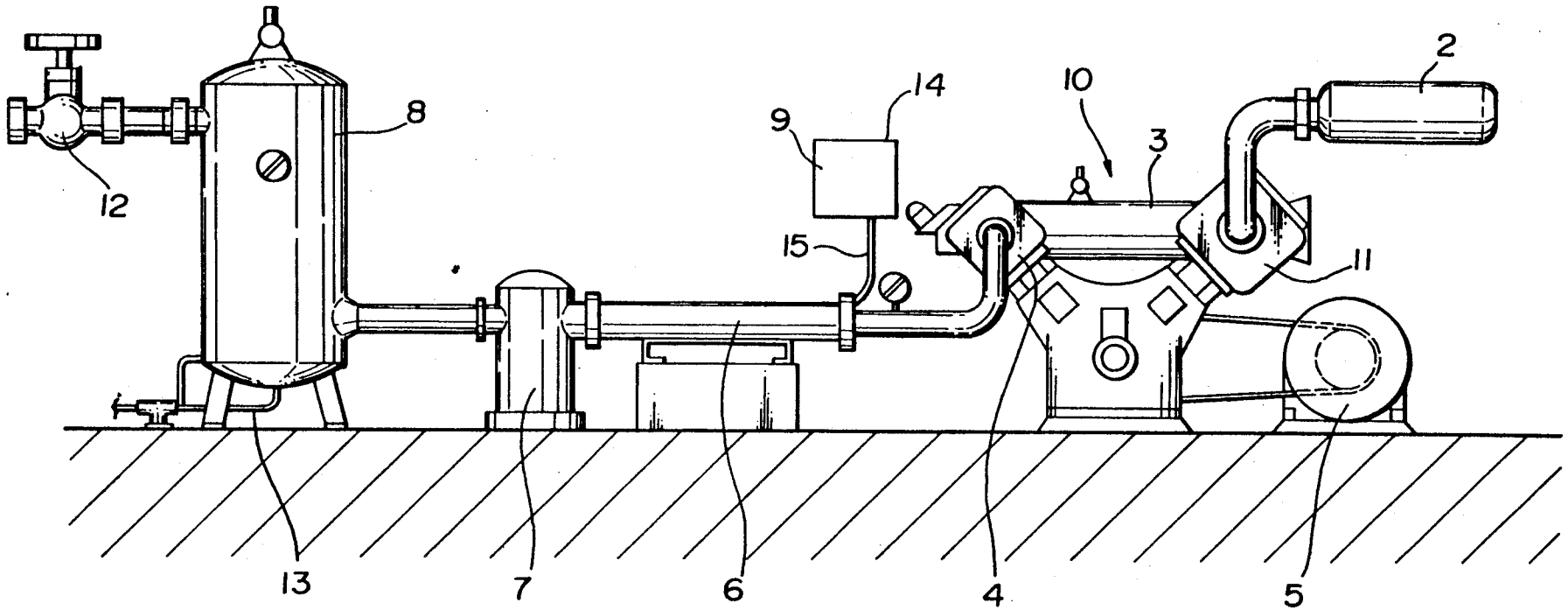
FIG. 1 is a side-elevational view of an anti-corrosion air compression device according to the present invention.

FIG. 1 illustrates an anti-corrosion air compression device according to the present invention. In this drawing, reference numeral 10 denotes an air compression unit including primary and secondary compression cylinders 11 and 4, a motor 5 for driving the primary and secondary cylinders, and an air intake filter 2 connected to the air inlet of the primary compression cylinder 11. The air outlet of the primary cylinder 11 is communicatively interconnected with the air inlet of the secondary cylinder 4 by a primary heat dissipator 3. The outlet of the secondary compression cylinder 4 is connected to a secondary heat dissipater 6. This heat dissipater 6 is connected to a compressed air storage tank 8 via a compressor drain 7. Reference numeral 12 designates an outlet valve for taking compressed air out of the tank 8. Reference numeral 13 designates a drain pipe for draining collected runoff from the interior of the tank 8. Above-mentioned parts constitute an air compressing means in the form of a conventional air compressor.

As is further shown in FIG. 1, a basic solution dispensing means in the form of an ionized alkaline water supplying unit 9 is connected to the secondary heat dissipator 6. This water supplying unit 9 comprises, a commercially available electrolysis device 14 with a solution container, a conduit tube 15 communicatively interconnecting the solution container with the inlet of the heat dissipator 6, a pressurizing pump (not shown) for drawing a basic solution from the container into the conduit tube 15, a nozzle (not shown) connected to the end of the conduit tube 15 to spray a basic solution into the heat dissipator 6, and a control check valve (not shown) provided on the conduit tube 15 to control the flow rate of the basic solution to be sprayed into the heat dissipator 6. The pressurizing pump is capable of pressuriing the basic solution to a pressure higher than the pressure of the compressed air in the heat dissipater 6. The control check valve limits the flow of the alkaline water in the conduit tube 15 to a single direction of flow so that the alkaline water does not back-flow into the solution container due to the interior pressure of the compressor.

A basic solution, ionized alkaline water in this embodiment, is produced by the electrolysis device 14. For example, a solution of water and a commercially available inexpensive salt such as sodium chloride and calcium chloride, is put into the solution container, and then the solution is electrolyzed. During the electrolysis, chlorine and hydrogen evolve out of the solution, and thus an excess of hydroxyl ion remains in the solution. This causes the solution to become an ionized and alkaline. Such an ionized alkaline water can also be obtained by electrolyzing ordinary tap water which includes chlorine or sulphur.

During the operation of the anti-corrosion air compression device, atmospheric air drawn into the air compressor via the air inlet filter 2 is compressed by the primary and secondary compression cylinders 11 and 4, and the compressed air is cooled by the heat dissipaters 3 and 6. Then, the compressed air is introduced into the air storage tank 8 via drain 7. During this air compression operation, water vapor contained in the drawn atmospheric air precipitates and forms a mist in the air and droplets or runoff on the interior surface of the compressor. The quantity of this precipitate is appreciable, often amounting to approximately 1 liter of precipitate per 100 $m^2$ of atmospheric air at 30° C. and 80% humidity. This precipitation occurs in both the primary and secondary heat dissipates 3 and 6, but the majority occurs in the secondary heat dissipator 6. This secondary heat dissipator 6 therefore is primarily exposed to the corrosive precipitate. For this reason, the alkaline water supplying unit 9 is, in this embodiment, connected to the heat dissipater 6.

The supplying unit 9 pressurizes the alkaline water to a pressure higher than the pressure of the compressed air, and sprays the pressurized alkaline water at a suitable flow rate continuously or at intervals into the heat dissipator 6 so that the precipitated acidic mist and acidic runoff are neutralized or made slightly basic to counteract any a corrosive effects on the interior surface of the heat dissipator 6. The neutralized or basic runoff is then collected by the drain 7 and is drained away. Some of the precipitated mist, which was neutralized by the alkaline water, is introduced into the storage tank 8, but does not act as a corrosive agent. Further, part of the introduced mist in the tank 8 may be collected in the form of runoff and may be drained away through the drain pipe 13.

By using the control check valve, the flow rate of the alkaline water to be sprayed is adjusted to a rate not less than a rate suitable for neutralizing the precipitated acidic water. The suitable flow rate for neutralizing can be calculated from the pH of the alkaline water, the pH of the acidic water which precipitates, and the quantity of the acidic water which precipitates per unit time. For example, when 50 liters of a pH 5 acidic water precipitates in the dissipater 6 per hour, and when the pH of the produced alkaline water is 10, the suitable flow rate of the alkaline water is 5 liters per hour. The quantity of the acidic precipitate can be estimated from the quantity of ambient air to be compressed per unit time, the temperature and humidity of the ambient air, the pressure of the compressed air, and the temperature to which the compressed air is cooled by the heat dissipator 6. The pH of the acidic precipitate in the secondary heat dissipater 6 may be monitored by checking the pH of the precipitate in the primary heat dissipater 3. Monitoring the pH of the collected runoff in the drain 7 makes it possible to readjust the flow rate of the alkaline water to be sprayed so that the precipitated water is properly neutralized or made basic.

In the foregoing embodiment, the alkaline water supplying unit 9 is connected only to the secondary heat dissipater 6. However, the supplying unit 9 may be provided to the primary heat dissipater 3 or even to the air storage tank 8. In case of providing the unit 9 to the tank 8, it is preferred that the nozzle of the unit 9 be connected to the roof section of the tank 8. Instead of generating the alkaline water by the electrolysis device 14, a solution container may be employed to receive a prepared basic solution. Also, in order to reduce the amount of precipitated water, a commercially available dehumidifier for removing a substantial amount of water vapor from the air may be connected to that portion of the compressor between the inlet filter 2 and the primary compression cylinder 11.

What is claimed is:

1. A method of preventing corrosion on the interior surface of an air compressing means, the air compressing means being designed for drawing atmospheric air thereinto and compressing the drawn air, the air compressing means having an interior surface made primarily of a metal with which the compressed air comes into contact, the air compressing means including a section in which occurs condensation of water vapor in the compressed air, the method comprising the steps of:

preparing a basic solution by electrolyzing a solution of water with a substance selected from the group of salt, chlorine and sulphur, whereby the solution becomes ionized and alkaline; and supplying the prepared basic solution to the interior of said section so that the condensed water is neutralized or made weakly basic by the supplied basic solution.

2. A method according to claim 1, wherein the supplying step comprises the step of adjusting the flow rate of the basic solution to be supplied to the section to a rate not less than a rate suitable for neutralizing the condensed water.

3. A method according to claim 1, wherein the supplying step comprises the steps of: pressurizing the basic solution to a pressure higher than the pressure of the compressed air in said section; and spraying the pressurized basic solution into said section.

* * * * *